United States Patent [19]

Downing

[11] 3,944,073

[45] Mar. 16, 1976

[54] COMBINED REINFORCING AND SUPPORT MEANS FOR THE CORNERS OF A COLLAPSIBLE CONTAINER

[75] Inventor: Benjamin A. Downing, Peoria, Ill.

[73] Assignee: Caterpillar Tractor Co., Peoria, Ill.

[22] Filed: Nov. 27, 1974

[21] Appl. No.: 527,721

[52] U.S. Cl. ..... 206/503; 206/821; 217/65

[51] Int. Cl.[2] ..... B65D 21/02

[58] Field of Search ..... 206/503, 821; 217/65

[56] References Cited

UNITED STATES PATENTS

| | | | |
|---|---|---|---|
| 1,046,018 | 12/1912 | Reber | 229/49 |
| 1,912,847 | 6/1933 | Klepol | 206/821 |
| 2,775,389 | 12/1956 | Weiner | 229/23 |
| 3,071,277 | 1/1963 | Olson | 217/69 |
| 3,073,500 | 1/1963 | Goodrich et al. | 229/14 |
| 3,480,178 | 11/1969 | Morgan | 206/821 |
| 3,797,727 | 3/1974 | Downing et al. | 224/49 |

*Primary Examiner*—George E. Lowrance
*Attorney, Agent, or Firm*—Phillips, Moore, Weissenberger Lempio & Strabala

[57] ABSTRACT

A container comprises a horizontally disposed base having upstanding and contiguous side walls disposed thereon to define an open top compartment. A combined reinforcing and support member is attached to an upper end of each corner of the container, defined at the juncture of each adjacent pair of side walls, and has a horizontally disposed platform bridged between such pair of side walls.

14 Claims, 2 Drawing Figures

COMBINED REINFORCING AND SUPPORT MEANS FOR THE CORNERS OF A COLLAPSIBLE CONTAINER

BACKGROUND OF THE INVENTION

U.S. Pat. No. 3,797,727, assigned to the assignee of this application, discloses a collapsible container primarily used for the bulk storage and transportation of small parts in a manufacturing plant. The container comprises a horizontally disposed base having upstanding and contiguous side walls, composed of a corrugated material, attached on the base to define an open top compartment. It has been found desirable to stack such containers on each other to more efficiently utilize floor space and to adapt simultaneous transportation of the containers by a fork lift truck or the like.

SUMMARY OF THE INVENTION

An object of this invention is to provide an improved container of the type described above wherein the structural integrity and anti-racking capabilities thereof is increased and a stacking platform is provided to receive additional stacked containers thereon. To this end, this invention is drawn to an economical and reusable combined reinforcing and support means which exhibits a rugged construction and ability to be applied to the container walls expeditiously. Each of the means is positioned at a respective upper corner of the container and comprises a horizontally disposed platform portion bridged between a respective pair of the side walls to collectively provide a substantial support for the stacked containers.

BRIEF DESCRIPTION OF THE DRAWING

Other objects of this invention will become apparent from the following description and accompanying drawing wherein.

DETAILED DESCRIPTION

Figure 1:
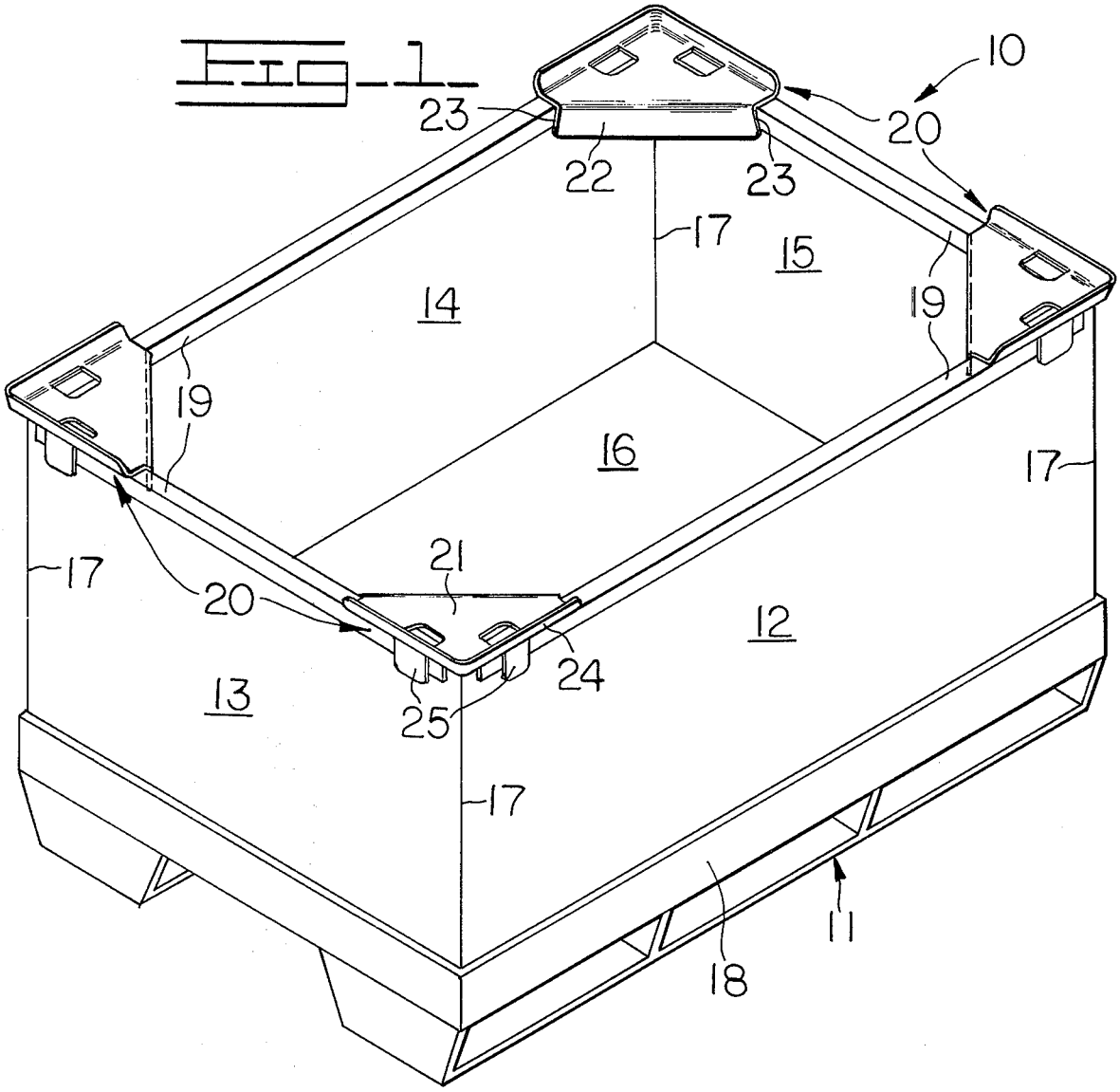
FIG. 1 is an angular perspective view of a collapsible container embodying the present invention.

Referring to the drawing, a collapsible container 10 of rectangular cross-section comprises a horizontally disposed base or pallet assembly 11 composed of a substantially rigid material, such as steel or wood. A collapsible sleeve, formed by four upstanding and contiguous side walls 12–15 is disposed on the base and a separable flat bottom sheet 16 is positioned within the sleeve. The sleeve and bottom sheet are preferably composed of a standard corrugated paperboard material of the type described in above mentioned U.S. Pat. No. 3,797,727. Such patent discloses further details of the container which is adapted for expeditious assembly and knock-down for storage purposes.

Each pair of adjacent side walls are hingedly connected at a common score line 17 to form a right angle corner thereat. The lower ends of the sidewalls are telescopically received within the confines of a continuous flange 18 formed on the perimeter of pallet assembly 11. An inverted U-shaped rail 19 is closely fitted on the upper edge of each of the side walls to form a part thereof for purposes of this invention and extends substantially the full length of the sidewall to provide reinforcement and anti-wear capabilities thereat.

Figure 2:
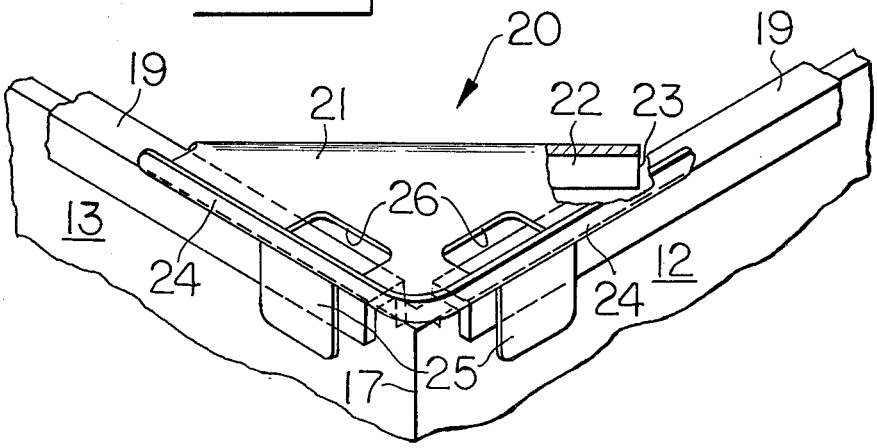
FIG. 2 is an enlarged perspective view of the upper end of a corner of the container, having a combined reinforcing and support means of this invention attached thereto.

This invention is drawn to a combined reinforcing and support means 20 attached to an upper end of each of the corners of the container to increase the stacking strength thereof and to provide an anti-racking capability thereat. In addition, such means collectively provide a substantial support for additional containers stacked thereon. Referring to FIG. 2, means 20 preferably takes the form of a removable metallic (e.g., stamped steel) bracket having a horizontally disposed and triangularly shaped platform portion 21, having its apex disposed at a corner of the container, bridged between a respective pair of rails of an adjacent pair of side walls. A locating flange 22, having outer ends 23, extends downwardly from the inboard edge of the platform portion, defining the base thereof. A right angle stacking flange 24 extends upwardly from the outboard edges of the platform portion and is central at the apex thereof.

A pair of downwardly extending tabs or clamping flanges 25 are pre-punched at right angles out of platform portion 21, as defined by openings 26, to straddle an outboard side of a respective rail 19 on either side of a corner of the container. The tabs cooperate with flange 22, outer longitudinal ends 23 of which abut inboard sides of adjacent rails 19, to prevent lateral movement of means 20 relative to the container. Stacking flange 24 functions to prevent lateral movement of the corner of an additional container (not shown) disposed in stacked relationship on platform portion 21.

From the above description it becomes obvious that means 20 enhance the overall stacking strength of the container as well as providing an anti-racking feature at each corner thereof. In addition, the means collectively provide a substantial support for the stacking of additional containers thereon. When it is desired to store the container, it may be disassembled expeditiously by simply removing means 20 and rails 19 whereafter the remaining components of the container may be disassembled in the manner described in above referenced U.S. Pat. No. 3,797,727.

I claim:

1. In a container of the type comprising a horizontally disposed base and upstanding, contiguous side walls positioned on said base to define an open top compartment therewith and a corner at the intersection of each pair of adjacent side walls, the improvement comprising a rigid combined reinforcing and support means attached to an upper end of each of said corners, said means comprising a horizontally disposed platform portion bridged between a respective pair of said side walls to collectively provide a substantial support with the other of said platform portions for additional containers stacked thereon, a locating flange formed on an inboard edge of said platform portion to extend vertically downwardly therefrom, a stacking flange formed on outboard edges of said platform portion to extend vertically upwardly therefrom and clamping flanges formed on the outboard edges of said platform portion to extend downwardly in at least general vertical alignment with said stacking flange and straddling respective side walls of said container along with said locating flange.

2. The container of claim 1 wherein four of said side walls constitute a collapsible sleeve composed of a corrugated paperboard material and wherein each pair of adjacent side walls are disposed at a right angle relative to each other and are hingedly connected together at a common scoreline.

3. The container of claim 1 wherein said base comprises an upstanding flange formed around the perimeter thereof, said side walls being telescopically disposed within said flange.

4. The container of claim 1 wherein each of said sidewalls comprises an inverted rail of U-shaped cross section mounted on its upper edge to extend substantially the full length thereof, one of said means detachably mounted on an adjacent pair of said rails.

5. The container of claim 1 wherein said platform portion is triangularly shaped to have its apex disposed at a respective corner of said container.

6. The container of claim 5 wherein the inboard edge of said platform portion defines a base of the triangular shape thereof, and wherein said locating flange extends diagonally into abutting relationship with a respective pair of said side walls at lateral ends of said locating flange.

7. The container of claim 5 wherein said stacking flange is continuous and is formed at a right angle relative to said platform portion and is centered at an apex of said platform portion.

8. The container of claim 1 wherein said clamping flanges are formed out of said platform portion and extend downwardly from said platform portion on either side of a respective corner of said container and each is disposed in straddling relationship with respect to an outboard side of a respective side wall.

9. The container of claim 8 wherein each of said sidewalls comprises an inverted U-shaped rail mounted on its upper edge to extend substantially the full length thereof and wherein each of said clamping flanges abuts an outboard side of a respective one of said rails.

10. The container of claim 9 wherein said locating flange extends diagonally between inboard sides of a pair of adjacent walls and is disposed in abutting relationship therewith to cooperate with said clamping flanges to prevent lateral movement of said means relative to said rails.

11. A rigid reinforcement and support bracket adapted for attachment to an upper end of a corner of a container comprising a flat triangularly shaped platform portion defining an inboard edge and a pair of outboard edges each intersecting with said inboard edge and with each other at an apex of said support portion, a locating flange extending downwardly from the inboard edge of said platform portion and extending at least substantially the full length thereof, a stacking flange extending upwardly from the outboard edges of said platform portion and at least one clamping flange formed out of said platform portion and extending downwardly from an outboard edge thereof in at least general alignment with said stacking flange.

12. The bracket of claim 11 wherein said stacking flange is continuous and is formed at a right angle relative to said platform portion and is centered at the apex of said platform portion.

13. The bracket of claim 12 wherein a pair of said clamping flanges each extends downwardly from a respective outboard edge of said platform portion on a respective side of the apex thereof.

14. The bracket of claim 13 wherein each of said clamping flanges is formed out of said platform portion and is disposed at a right angle relative thereto.

* * * * *